US009364968B2

(12) United States Patent
Takahashi

(10) Patent No.: US 9,364,968 B2
(45) Date of Patent: Jun. 14, 2016

(54) CHAIN TENSION ADJUSTMENT DEVICE OF CHAIN SAW

(71) Applicant: MAKITA CORPORATION, Aichi (JP)

(72) Inventor: Satoshi Takahashi, Tokyo (JP)

(73) Assignee: MAKITA CORPORATION, Aichi (JP)

( * ) Notice: Subject to any disclaimer, the term of this patent is extended or adjusted under 35 U.S.C. 154(b) by 87 days.

(21) Appl. No.: 14/467,319

(22) Filed: Aug. 25, 2014

(65) Prior Publication Data

US 2015/0059191 A1 Mar. 5, 2015

(30) Foreign Application Priority Data

Sep. 2, 2013 (JP) ..... 2013-181045

(51) Int. Cl.
*B27B 17/02* (2006.01)
*B27B 17/14* (2006.01)

(52) U.S. Cl.
CPC ..... *B27B 17/14* (2013.01); *B27B 17/02* (2013.01)

(58) Field of Classification Search
CPC ..... B27B 17/14; B23D 7/00; B23D 7/023; F16H 7/08
USPC ..... 30/386; 83/816
See application file for complete search history.

(56) References Cited

U.S. PATENT DOCUMENTS

| | | | |
|---|---|---|---|
| 4,567,658 | A | 2/1986 | Wissmann et al. |
| 2006/0000098 | A1 | 1/2006 | Kawamura |
| 2009/0241353 | A1 | 10/2009 | Ericson et al. |

FOREIGN PATENT DOCUMENTS

| | | |
|---|---|---|
| DE | 9311081 | 11/1994 |
| DE | 102005030390 | 2/2006 |
| JP | 4-72681 B2 | 11/1992 |
| JP | 2013-188947 | 9/2013 |

OTHER PUBLICATIONS

Germany Office action, dated Mar. 27, 2015 along with an English translation thereof.

*Primary Examiner* — Kenneth E. Peterson
*Assistant Examiner* — Samuel A Davies
(74) *Attorney, Agent, or Firm* — Greenblum & Bernstein, P.L.C.

(57) ABSTRACT

To provide a chain tension adjustment device for a chain saw. When a first mechanism is rotated around an axis, a bevel gear of a second mechanism is engaged with a bevel gear of the first mechanism and rotated, and a bevel gear of a third mechanism is engaged with the other bevel gear of the second mechanism, so that a shaft portion is rotated. A plate portion integrated with a nut portion of a fourth mechanism screwed on a screw formed on the shaft portion moves in an axial direction, and a guide bar engaged with an engagement portion of the plate portion via an engagement hole moves in a longitudinal direction, to adjust tension of the chain saw by adjusting the movement amount. Thus, fine adjustment can be performed while reducing an operating force, and reducing the weight and the cost.

6 Claims, 5 Drawing Sheets

CHAIN TENSION ADJUSTMENT DEVICE OF CHAIN SAW

BACKGROUND OF THE INVENTION

1. Field of the Invention

The present invention relates to a device for use in a chain saw and for adjusting tension of a saw chain (chain) which is wound around and rotates around a guide bar.

2. Description of Related Art

In a chain saw, tension of a chain is adjusted by moving a guide bar in a longitudinal direction with respect to a sprocket which drives the chain, to adjust a distance between the sprocket and the guide bar.

As this type of chain tension adjustment device, there may be a configuration in which a tension operating device is incorporated into a chain cover outside a guide bar, and a configuration in which a tension device is incorporated into a chain-saw main body on which a guide bar is mounted.

In the former configuration, there may be disadvantages that it is required that an operating portion provided on the chain cover and a moved portion in the guide bar be engaged with high accuracy, and the assembling process may become difficult. In the latter configuration, such disadvantages can be avoided.

The latter configuration in which the entire tension device is incorporated into the chain-saw main body is disclosed in JP H04-72681 B, and is as follows. A helical gear fixed to an operation shaft is engaged with a helical gear fixed to an end of a screw shaft member. When the operation shaft is rotated around the axis by a driver, the screw shaft member is rotated around the axis thereof. Thus, the guide bar is moved in the axial direction together with a member which is screwed to the screw of the screw shaft member and is engaged with the guide bar, so that the tension of the chain is adjusted.

In the configuration disclosed in JP H04-72681 B, a gear mechanism for rotating the screw shaft member is constituted by a single-stage gear unit (one drive gear and one driven gear are provided). In this configuration, since it is required that the operation shaft and the screw shaft be spaced apart from each other by a predetermined distance, for example, the sizes of the gears thereof are increased to enable the engagement therebetween. In particular, since the size of the driven gear, the radial direction of which is perpendicular to the surface of the guide bar, is limited by an installation space, the size of the drive (operating) gear should be relatively increased.

Accordingly, a gear ratio (the number of teeth of drive gear/the number of teeth of driven gear) is increased, a pitch of the gear is also increased, and thus, a backlash is also increased. As a result, it may be difficult to perform smooth and fine adjustment of the tension of the chain, and an operating force needed for the adjustment may also be increased.

Moreover, due to the large gear, the weight of the entire gear mechanism may be increased.

In addition, since the operation shaft and the axial direction of the screw shaft are perpendicular to and offset to each other, helical gears are used in the single-stage gear unit. Since a cutting process is necessary to form the helical gear, the cost may be increased.

SUMMARY OF THE INVENTION

The present invention is made in consideration of the above-described problems, and an object thereof is to provide a chain tension adjustment device for a chain saw capable of performing smooth and fine adjustment of tension of a chain by a less operating force and capable of reducing the weight and the cost of a gear mechanism.

In order to achieve the object, according to an aspect of the present invention, there is provided a chain tension adjustment device for a chain saw, in which a guide bar with a saw chain wound around an outer circumference portion of the guide bar is moved in a longitudinal direction of the guide bar to adjust tension of the saw chain, the device including: a first mechanism that is rotated around an axis thereof by a manual operation and includes a first drive bevel gear formed on an end opposite to an operation end; a second mechanism that includes a first driven bevel gear formed on one end in an axial direction of the second mechanism and engaged with the first drive bevel gear, and a second drive bevel gear formed on the other end in the axial direction; a third mechanism that includes a second driven bevel gear formed on one end in an axial direction of the third mechanism and engaged with the second drive bevel gear; and a fourth mechanism that is linked to the third mechanism and the guide bar, and converts rotational motion rotating around an axis of the third mechanism into motion in the longitudinal direction of the guide bar, in which the first to fourth mechanisms are disposed in a chain-saw main body on which the guide bar is mounted.

According to the aspect of the present invention, since the gear mechanism is provided with the first-stage gears including the first drive bevel gear of the first mechanism and the first driven bevel gear of the second mechanism, and the second-stage gears including the second drive bevel gear of the second mechanism and the second driven bevel gear of the third mechanism, the size of each gear can be sufficiently reduced.

Accordingly, a pitch of each gear can be reduced, and a gear ratio can be independently set for each stage, and thus, it is possible to perform smooth and fine adjustment of the tension of the chain, and an operating force needed for the adjustment can be reduced.

Moreover, a total weight of the gear mechanism can be reduced, and the gear mechanism can be incorporated into the chain-saw main body in a compact manner.

In addition, since bevel gears can be used, the gears can be shaped with a die, a cutting process of teeth is not required, and the cost can also be reduced.

Other objects and features of the aspect of the present invention will be understood from the following description with reference to the accompanying drawings.

DESCRIPTION OF PREFERRED EMBODIMENTS

Hereinbelow, an embodiment of the present invention will be described with reference to the drawings.

Figure 1:
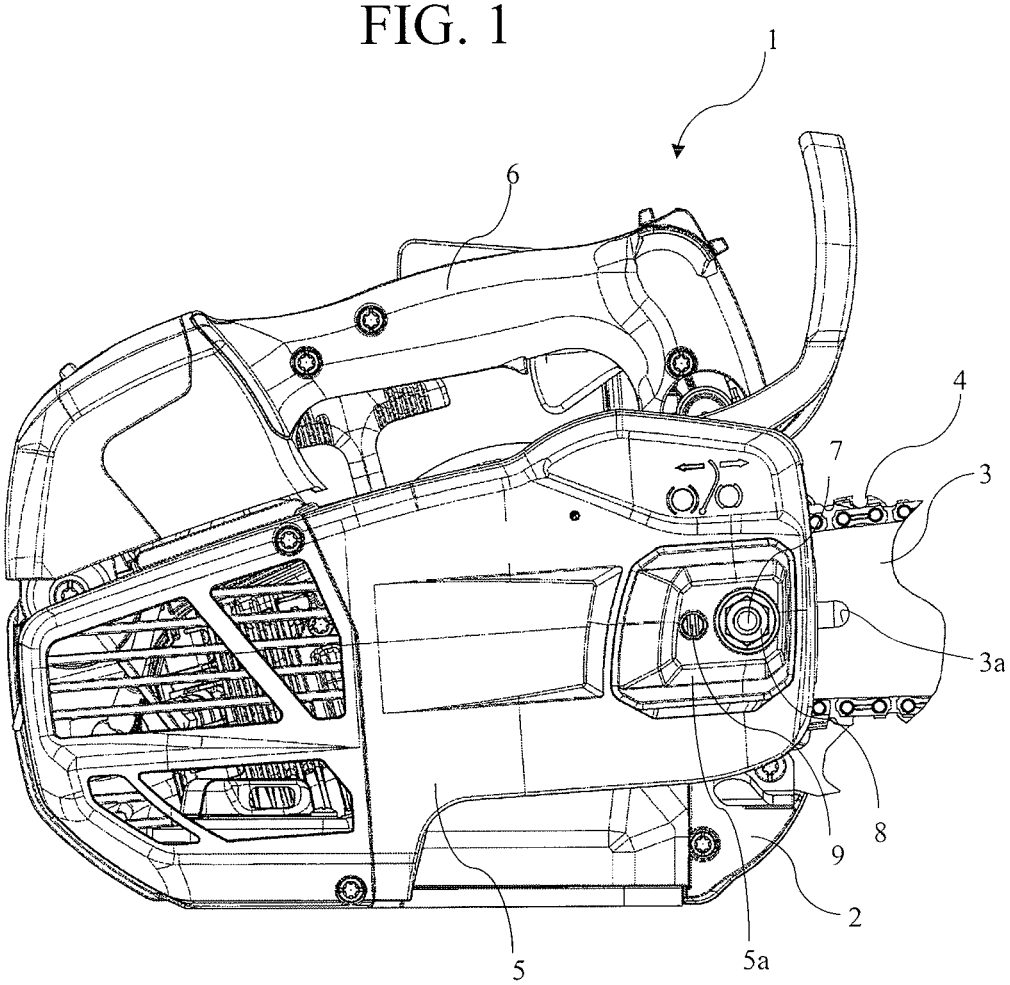
FIG. 1 is a front view illustrating the overall configuration of a chain saw according to an embodiment of the present invention.

FIG. 1 illustrates the overall configuration of a chain saw according to an embodiment of the present invention.

In a chain saw 1, a guide bar 3 extending to the front side is mounted on a chain-saw main body 2. A saw chain 4 is wound around a peripheral edge portion of the guide bar 3.

In the chain-saw main body 2, the saw chain 4 is engaged with a sprocket (not illustrated) driven to be rotated by a motor, such as an engine or an electric motor, so that the saw chain 4 rotates around the peripheral edge portion of the guide bar 3.

An area in which a part of the guide bar 3, the sprocket, which is adjacent to the guide bar 3 and driven to be rotated with the saw chain 4 engaged therewith, and the like are disposed, is covered by a chain cover 5, and the chain cover 5 is mounted on the main body 2.

At the upper portion of the main body 2, a handle 6 integrated with the chain cover 5 is provided.

Figure 2:
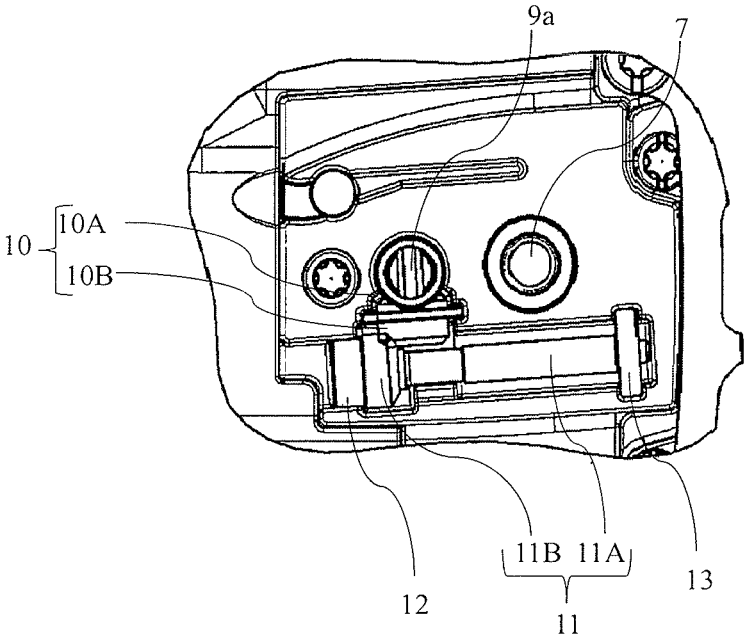
FIG. 2 is a front view illustrating the main part of the chain saw in a state in which a chain cover, a guide plate between a guide bar and a chain-saw main body, and a fourth mechanism are removed.
Figure 3:
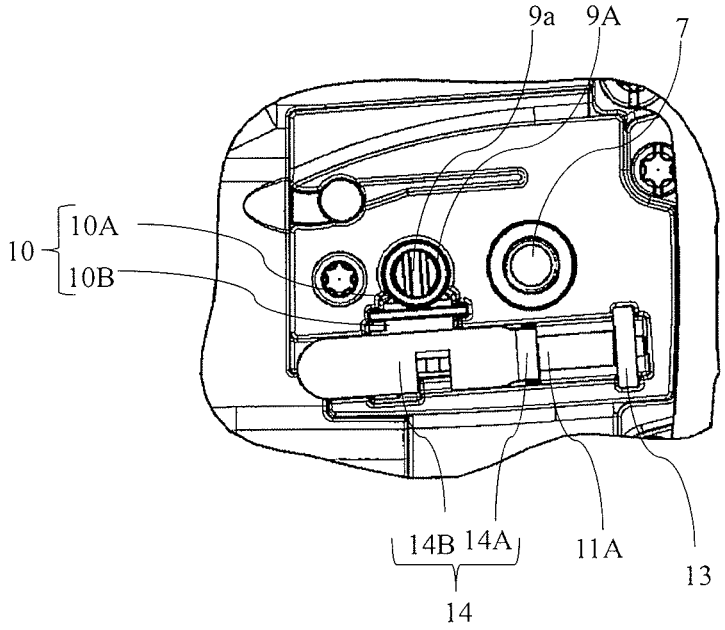
FIG. 3 is a front view illustrating the main part of the chain saw in a state in which the chain cover and the guide plate are removed.

As illustrated in FIGS. 1 to 3, an operation concave portion 5*a* is formed on the chain cover 5. A long hole 3*a* is formed on the guide bar 3, and a stud bolt 7 penetrating through the long hole 3*a* is secured to the chain-saw main body 2.

An end of the stud bolt 7 penetrates through the operation concave portion 5*a* of the chain cover 5 and is exposed. The end of the stud bolt 7 is fastened by a nut member 8, and thus, one end of the guide bar 3 adjacent to the sprocket is interposed between the main body 2 and the chain cover 5 and is fastened.

Figure 4:
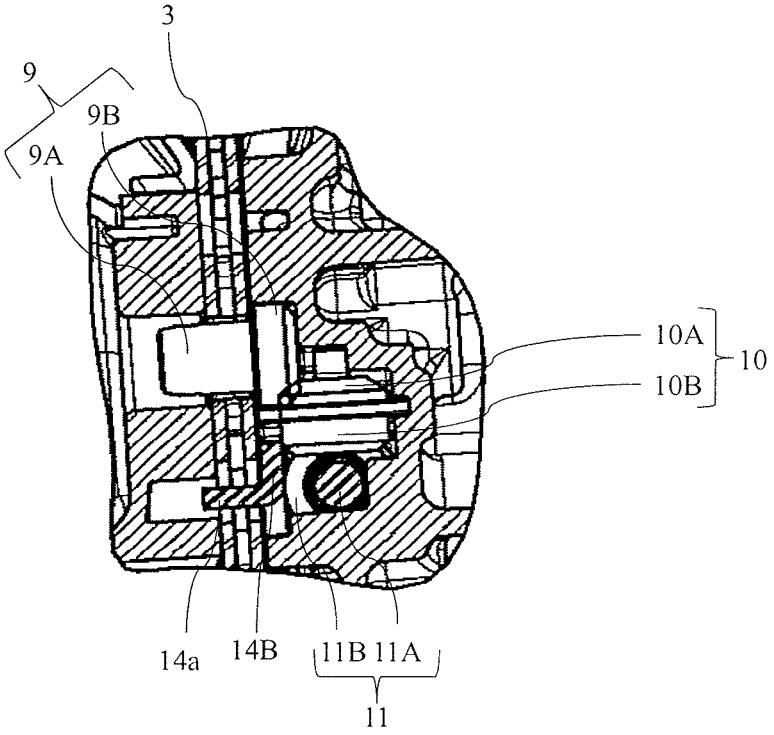
FIG. 4 is a longitudinal cross-sectional view of the main part of the chain saw.
Figure 5:
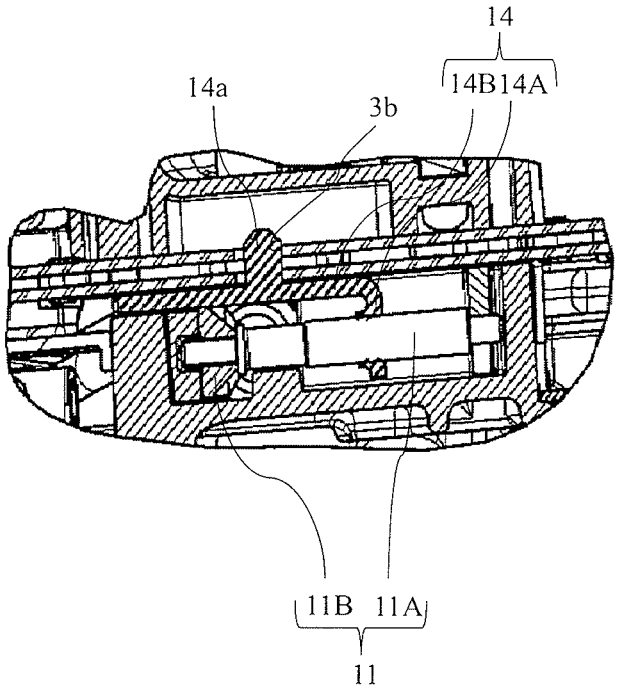
FIG. 5 is a cross-sectional view of the main part of the chain saw.

Moreover, as described below, a tension adjustment mechanism of the saw chain 4 is disposed so as to be incorporated into the chain-saw main body 2. Hereinbelow, the mechanism will be described with reference to FIGS. 4 and 5.

A first mechanism 9, which functions as an operation shaft member having an axial direction perpendicular to the surface of the guide bar 3, includes a shaft portion 9A which penetrates through the guide bar 3 and is exposed to the outside of the operation concave portion 5*a* of the chain cover 5, and a bevel gear 9B which is integrally formed with the shaft portion 9A and formed inside the guide bar 3. The bevel gear 9B functions as a first-stage drive gear (first drive bevel gear), is disposed in a groove formed in the chain-saw main body 2, and is supported so as to freely rotate around the axis.

A second mechanism 10 includes: a bevel gear 10A which is engaged with the bevel gear 9B and is formed on one end of a shaft portion, the axial direction of which is a vertical direction perpendicular to the first mechanism 9; and a bevel gear 10B which is formed on the other end of the shaft portion. The second mechanism 10 is disposed in a groove formed in the chain-saw main body 2 and is supported so as to freely rotate around the axis. The bevel gear 10A functions as a first-stage driven gear (first driven bevel gear), and the bevel gear 10B functions as a second-stage drive gear (second drive bevel gear).

A third mechanism 11 includes: a threaded shaft portion 11A, the axial direction of which is a longitudinal direction perpendicular to the first mechanism 9 and the second mechanism 10; and a bevel gear 11B which is formed on one end of the shaft portion 11A and engaged with the bevel gear 10B. The third mechanism 11 is disposed in a groove formed in the chain-saw main body 2 and is supported so as to freely rotate around the axis. The bevel gear 11B functions as a second-stage driven gear (second driven bevel gear).

The third mechanism 11 is borne by bearing members 12 and 13, both ends of which in the axial direction are inserted into grooves formed in the chain-saw main body 2. The motion moving in the axial direction parallel to the longitudinal direction of the guide bar 3 is regulated thereby and looseness is reduced. The bearing members 12 and 13 are formed of a resin material such as nylon.

A fourth mechanism 14, that is linked to the third mechanism 11 and the guide bar 3, and converts rotational motion rotating around the axis of the third mechanism 11 into motion in the longitudinal direction of the guide bar 3, is provided.

The fourth mechanism 14 includes: a nut portion 14A which is screwed on the screw of the shaft portion 11A of the third mechanism 11 on one end in the axial direction; and a plate portion 14B which is connected to the nut portion 14A and extends in the longitudinal direction.

At the center portion of the plate portion 14B, an engagement portion 14*a* which is bent so as to protrude to the guide bar 3 is formed, and the engagement portion 14*a* penetrates through an engagement hole 3*b* formed in the guide bar 3 and is engaged with the guide bar 3.

An operation of the tension adjustment mechanism having this configuration will be described hereinbelow.

When a driver is engaged with an operating groove 9*a* of the first mechanism 9 and rotated in one direction around the axis, the second mechanism 10 is rotated in one direction around the axis due to the engagement between the bevel gear 9B and the bevel gear 10A of the second mechanism 10.

When the second mechanism 10 is rotated in one direction around the axis, the third mechanism 11 is rotated in one direction around the axis due to the engagement between the bevel gear 10B and the bevel gear 11B of the third mechanism 11.

When the third mechanism 11 is rotated in one direction around the axis, the fourth mechanism 14 including the nut portion 14A and the plate portion 14B moves in one direction in the axial direction of the third mechanism 11 due to the screwing between the screw of the third mechanism 11 and the nut portion 14A of the fourth mechanism 14. Accordingly, the guide bar 3, which is engaged with the plate portion 14B, moves in one direction in the longitudinal direction thereof together with the fourth mechanism 14.

For example, when the first mechanism 9 is rotated in a clockwise direction, the second mechanism 10 is rotated in a clockwise direction when viewed from above, and the third mechanism 11 is rotated in a counterclockwise direction when viewed from the front side. When the screw of the third mechanism 11 is a general right-hand screw, the fourth mechanism 14 and the guide bar 3 move in a direction leaving away from the sprocket. This results in an increase in tension of the saw chain 4.

When the first mechanism 9 is rotated in a counterclockwise direction opposite to the above-described case, each mechanism is operated in the opposite direction, and the guide bar 3 moves in a direction approaching the sprocket, resulting in a decrease in tension of the saw chain 4.

Accordingly, by rotating the first mechanism 9 in the direction, in which current tension of the saw chain 4 is corrected, by a predetermined amount, the tension of the saw chain 4 can be adjusted to an appropriate level.

After the tension of the chain is adjusted in this way, the nut member 8 is rotated in the fastening direction (clockwise direction) and fastens the guide bar 3.

According to the chain tension adjustment device having the above-described configuration, the following effects can be obtained.

Since the gear mechanism is constituted by the two-stage gear unit, the size of each gear can be reduced. In particular, since the size of the operating gear can be reduced compared with conventional one, a gear ratio (the number of teeth of drive gear/the number of teeth of driven gear) can be reduced.

Accordingly, since a movement amount of the guide bar 3 with respect to an operation amount can be reduced, the tension of the saw chain 4 can be finely adjusted, and the operating force can also be reduced. Moreover, the number of teeth of the second drive bevel gear 10B of the second mechanism 10 can be less than the number of teeth of the first driven bevel gear 10A, and thus, the gear ratio can be further reduced and the accuracy of fine adjustment can be improved.

Moreover, since a pitch of teeth of each gear can be reduced and a backlash can also be reduced, the fine adjustment can be performed very finely and can be performed smoothly with less looseness. In addition, because the looseness is reduced, vibrations of the gears caused by the drive of the motor such as the engine can be reduced, and wear of the gears and the components of the chain-saw main body supporting the gears can be reduced.

Moreover, since the gear mechanism is constituted by the two-stage gear unit and the size of each gear can be reduced, the total weight of the overall gear mechanism can be significantly reduced. Although the number of gears increases when the gear mechanism is constituted by the two-stage gear unit, compared with that when the gear mechanism is constituted by a single-stage gear unit, the total weight can be reduced by reducing the size of each gear even when the number of gears increases since weight of gear increases proportional to approximately the cube of size of gear.

Moreover, since the two-stage gear unit using the second mechanism 10 is adopted, the rotational motion of the first drive bevel gear 9B can be converted into the rotational motion rotating around the vertical axis of the bevel gear 10B (second drive bevel gear) and the bevel gear 10B can be engaged with the second driven bevel gear 11B.

Furthermore, arrangement positions (axis-to-axis distance) of the first mechanism 9 and the third mechanism 11 are limited relating to the space of the chain-saw main body. However, any shaft length of the second mechanism 10 and any distance between the first driven bevel gear 10A and the second drive bevel gear 11B can be selected in accordance with the axis-to-axis distance between the first mechanism 9 and the third mechanism 11. As illustrated in the drawings, since the size of each gear in the second mechanism 10 can also be reduced, the second mechanism can be disposed in a small space of the chain-saw main body in a compact manner.

Thus, since the two-stage gear unit using the second mechanism 10 is adopted, the bevel gear, which is difficult to be used in the single-stage gear unit, can be used.

Since the bevel gear can be formed of sintered metal and the like with a die, and a cutting process of teeth is not required. Thus, all gears can be formed to be bevel gears, and the cost can be significantly reduced.

Moreover, since both ends of the third mechanism 11 are borne by the bearing members 12 and 13 with less looseness, wear of the third mechanism 11 and the components of the chain-saw main body due to their vibration can be reduced.

The entire contents of Japanese Patent Application No. 2013-181045, filed on Sep. 2, 2013, on which priority is claimed, are incorporated herein by reference.

While only a select embodiment has been chosen to illustrate and describe the present invention, it will be apparent to one skilled in the art from this disclosure that various changes and modifications can be made without departing from the scope of the invention as defined in the appended claims.

Furthermore, the foregoing description of the embodiment according to the present invention is provided for illustration only, and it is not for the purpose of limiting the invention, the invention as claimed in the appended claims and their equivalents.

What is claimed is:

1. A chain saw having a chain tension adjustment device a guide bar with a saw chain wound around an outer circumference portion of the guide bar, wherein the guide bar is moved in a longitudinal direction to adjust tension of the saw chain, the device comprising:

a first mechanism that is rotated around an axis thereof by a manual operation and includes a first drive bevel gear formed on an end opposite to an operation end;

a second mechanism that includes a first driven bevel gear formed on one end in an axial direction of the second mechanism and engaged with the first drive bevel gear, and a second drive bevel gear formed on the other end in the axial direction;

a third mechanism that includes a second driven bevel gear formed on one end in an axial direction of the third mechanism and engaged with the second drive bevel gear; and a fourth mechanism that is linked to the third mechanism and the guide bar, and converts rotational motion rotating around an axis of the third mechanism into motion in the longitudinal direction of the guide bar, wherein the first to fourth mechanisms are disposed in a chain-saw main body on which the guide bar is mounted.

2. The chain saw according to claim 1, wherein the fourth mechanism includes a nut portion which is screwed on a screw of the third mechanism, wherein the fourth mechanism is connected to the guide bar and moves the guide bar in the longitudinal direction together with the nut portion by a rotational motion of a shaft portion of the third mechanism.

3. The chain saw according to claim 2, wherein the fourth mechanism includes a plate portion which is connected to the nut portion and extends in the longitudinal direction of the guide bar, wherein an engagement portion formed on a part of the plate portion is engaged with an engagement portion formed on the guide bar.

4. The chain saw according to claim 1, wherein each bevel gear of the first mechanism to the third mechanism is formed of a sintered material.

5. The chain saw according to claim 1, wherein both ends in the axial direction of the third mechanism are supported by the chain-saw main body via bearing members.

6. The chain saw according to claim 5, wherein the bearing members are formed of a resin material.

* * * * *